United States Patent [19]

Milligan et al.

[11] Patent Number: 4,480,014

[45] Date of Patent: Oct. 30, 1984

[54] ELECTRICAL CONTACT MEANS WITH GOLD-NICKEL ALLOY OVERLAY

[75] Inventors: Edward J. Milligan; Delbert A. Nauman; Nathaniel R. Quick, all of Indianapolis, Ind.

[73] Assignee: AT&T Technologies, Inc., New York, N.Y.

[21] Appl. No.: 545,705

[22] Filed: Oct. 26, 1983

[51] Int. Cl.[3] ..... H01H 1/00

[52] U.S. Cl. ..... 428/672; 428/929; 200/268; 148/430; 420/512

[58] Field of Search ..... 420/512; 428/571, 598, 428/672, 929; 200/266, 267, 268, 269; 148/405, 430

[56] References Cited

U.S. PATENT DOCUMENTS

| | | | |
|---|---|---|---|
| 2,711,577 | 6/1955 | Leach | 428/672 |
| 3,459,516 | 8/1969 | Ty et al. | 29/191.6 |
| 3,484,209 | 12/1969 | Antler et al. | 29/195 |
| 3,607,150 | 9/1971 | McGinn | 29/199 |
| 3,711,383 | 1/1973 | Schiekel et al. | 428/672 |
| 4,342,893 | 8/1982 | Wolf | 428/673 |

OTHER PUBLICATIONS

Russell, R. J., "Properties of Inlay Clad Wrought Gold Alloys"; *Solid State Technology* pp. 39–48, vol. 19, (8/76).

*Primary Examiner*—L. Dewayne Rutledge
*Assistant Examiner*—Christopher W. Brody
*Attorney, Agent, or Firm*—R. F. Kip, Jr.

[57] ABSTRACT

Electrical contact tape having a base portion of nickel, copper or nickel-copper alloy and an overlay of metallic material on said base portion is improved by utilizing for such overlay a gold-nickel alloy of which the precentage by weight of nickel is in the range of from about 1.8% to 2.3%, the balance of the alloy being gold with or without one or more other metals other than nickel in trace amounts insufficient to produce precipitation thereof out of solution in the gold. Nibs of such tape are bonded to a leaf spring to form an electromechanical junction therewith, the gold-nickel alloy overlay of the nib being on its side away from the spring to provide an improved electrical contact surface for the spring contact assembly formed by such nib and spring.

2 Claims, 3 Drawing Figures

ELECTRICAL CONTACT MEANS WITH GOLD-NICKEL ALLOY OVERLAY

TECHNICAL FIELD

This invention relates generally to electrical contact materials which comprise a metallic base and an overlay on the base of noble metallic material, and which are bonded to spring members to provide by such overlay the contact surface of spring contacts used in making electrical connections. More particularly, this invention relates to improvements in the composition of the noble metallic material constituting such overlay.

BACKGROUND OF THE INVENTION

In a copending application, Ser. No. 508,832, entitled "Electrolytic Methods for Enhancing Contrast Between Metallic Surfaces," filed June 27, 1983 in the name of Delbert A. Nauman, and assigned to the assignee hereof, there is disclosed electric contact material in the form of electrical contact tape comprising a wire-like nickel, copper or nickel/copper strip and an overlay of noble metallic material on the top of such strip. A commonly used composition for such overlay has been alloy consisting of the percentages by weight of about 3.5% cobalt, about 3.0% nickel and about 93.5% gold. When, however, segments of contact tape with an overlay of such composition have been incorporated in spring contacts used under field conditions in environments (such as those of hospitals) where the atmosphere contained airborne organic substances such as alcohols, an undue rate of premature electrical failures of such spring contacts has been observed.

SUMMARY OF THE INVENTION

According to the invention, we have discovered that such premature electrical failures in such environments of such spring contacts can be minimized or eliminated altogether by providing for use in such contacts an electrical contact material incorporating the improvement that the overlay on the metallic base is constituted of an alloy containing a percentage by weight of nickel in the range between 1.8% and 2.3%, the balance of the percentage by weight being gold or an admixture of gold and one or more trace metals, none of which is present in an amount to be precipitatable out of solution.

BRIEF DESCRIPTION OF THE DRAWINGS

For a better understanding of the invention, reference is made to the following description of exemplary embodiments thereof, and to the accompanying drawings wherein.

DETAILED DESCRIPTION OF EMBODIMENTS

Figure 1:
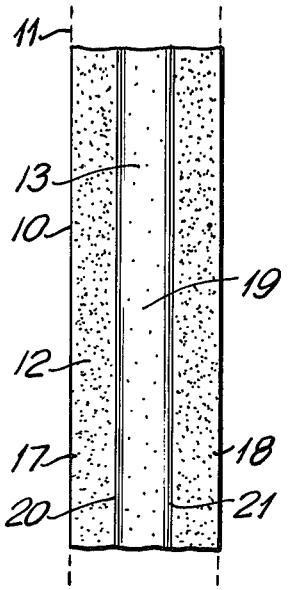
FIG. 1 is a plan view of a broken-away segment of electrical contact material incorporating the improvement according to the invention.

Referring now to FIG. 1, the reference numeral 10 designates a segment of electric contact material 11 of much greater length than the segment and from which the segment has been broken away. Contact material 11 comes in rolls (not shown) and is of a form which can be variously described as a coilable wire or strip, but which is commonly referred to in the art as a "tape." The contact material 11 comprises a substrate or base 12 and an overlay 13 centrally disposed on, and covering part of the base 12. Elements 12 and 13 as seen from the top are of strip form.

Figure 2:
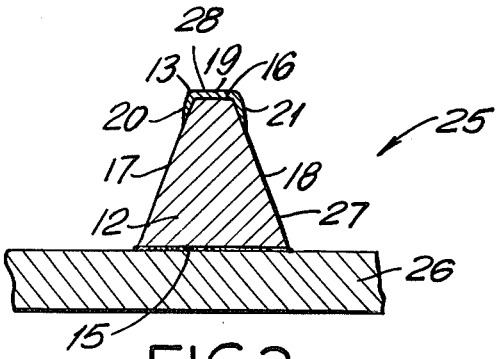
FIG. 2 is a front elevation in cross-section of a stub length of the FIG. 1 material as welded to an underlying leaf spring member (shown in broken-away section) so as to together form a spring contact assembly.

As shown in FIG. 2, the base 12 of the contact material 11 is, in cross-section normal to its length dimension, in the form of an isosceles trapezoid having a bottom 15, a top 16 parallel to the bottom and two sloping sides 17 and 18 of equal length joining the top and bottom. Overlay 13 has a central portion 19 wholly covering the base top 16. On opposite sides of central portion 19, overlay 13 has two border portions 20 and 21 extending partly down and overhanging the sides 17 and 18, respectively, of the base 12. The overlay 13 is bonded to the base 12 either mechanically by roll bonding or otherwise by the applying to a strip of the overlay of heat and pressure causing it to adhere to the base.

Exemplary dimensions for the base 12 are about 0.03 inch for the width of the bottom 15, about 0.008 inch for the width of the top 16 and a height of about 0.015 inch between such bottom and top. Overlay 13 has a thickness of only about 0.0004 inch, and its border portions 20 and 21 extend down over the sides 17 and 18 of the base by about 0.002 inch. The dimensions of the contact material 11 normal to its length are thus very small.

Figure 3:
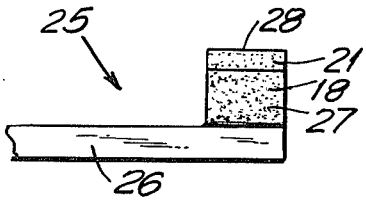
FIG. 3 is a side elevation of the FIG. 2 spring contact assembly with the left end of the spring member thereof being broken away.

FIGS. 2 and 3 are illustrative of a spring contact assembly 25 formed by welding to one side of a phosphor bronze leaf spring member 26 a stub length of contact material 11 severed from the length of electrical contact tape so that such welded stub length furnishes for the spring assembly a contact nib 27 providing an electrical contact surface 28 for such assembly, the nib 27 having a length of, say, 0.1 inch. Exemplary dimensions for member 26 are a thickness of between 0.005 inch and 0.014 inch, a width of 0.13 inch, and a length of 1 to 1¼ inches. The left-hand end of member 26 may be attached in various conventional ways (not shown) to other parts of the electrical circuitry of telephone equipment.

For the purposes hereof the base 12 may conveniently be constituted of nickel, but may also be constituted of copper, nickel, nickel alloy, copper alloy or any other metal, alloy or metallic material which (a) permits satisfactory bonding by welding or otherwise of a stub length of the contact material 11 to a spring member of, say, phosphor bronze (so as to thereby provide a spring contact by such joined elements), and (b) prevents diffusion of metal from the underlying spring member to the overlay of the contact tape segment bonded to such member.

Coming now to the events which led up to the present invention, because of repeats of field failures in hospital environments of spring contacts having contact surfaces provided by the described cobalt-nickel-gold alloy ("699" alloy), an investigation was undertaken to attempt to determine the cause of the failures. To this end, there was built a contact testing device incorporating a plurality of wiping contacts each comprising a nib 27 of contact material 11 welded onto a full hard temper phosphor bronze spring 26 to form a spring contact assembly of the kind shown by FIGS. 2 and 3. The base 12 of such contact material was, by percentage weight, 80% copper and 20% nickel, and the overlay of such contact material was of 699 alloy. The wiping contacts could be operated by the device to undergo successive closures with other contact elements under conditions where the contact force was on the order of 15 to 16 grams, and contact wipe was observed. After completion of the device, the investigation proceeded as follows. After cleaning the wiping contacts for the device with deionized distilled water and lint-free paper, they were field tested by the device in a clean medical environment. This environment is partially comprised of airborne antiseptics such as alcohols. Contact closure was infrequent in this environment, i.e., less than 1220 cycles over the four-month period.

These contacts, exhibiting an initial static resistance of 50 milliohms or lower, showed failures; after field testing their static resistance increased from 79 to 1398 milliohms.

The contacts were optically examined with a low power microscope, 7× to 80× magnification. All the contacts were surprisingly clean and showed no indication of any gross visible contaminant which might be causing early failure of these low usage contacts. This result prompted laboratory investigation of plausible field microscopic and optically transparent contaminants on the contacts.

Field contacts that failed resistance testing as well as contacts that were good (i.e., contact resistance less than 50 milliohms) were surface analyzed. Both types of contacts were first microtomed at a very shallow angle through the thickness of gold to the nickel base. The contacts considered were then analyzed first using a Cambridge Steroscan 180 scanning electron microscope/Tracor Northern TN-2000 energy dispersive X-ray (SEM/EDX). Samples that exhibited visible surface structures not chemically analyzable by EDX were then submitted for analysis by a Scanning Auger Microscope (SAM 590). The experimental results of such analysis were as follows.

Microforming of samples of worn and unworn contacts utilizing 699 alloy revealed agglomerates on the order of 6 to 8 microns on the SEM.

These agglomerates were rich in nickel and cobalt as determined by EDX. The wide ranges of alloying elements from point to point throughout the sample concurred with the observation of agglomerates. Gold varied from 90.7 percent to 100 percent, cobalt from 0 percent to 6.4 percent, and nickel from 0 percent to 4.0 percent. This is in comparison to the specified nominal quantities of gold (93.5 percent), cobalt (3.5 percent) and nickel (3.0 percent) for alloy 699. On the edges of the contact large quantities of copper were found, sometimes as much as 52.9 percent. The copper source is presumed to be transferred from the phosphor bronze spring substrate during batch deburring and cleaning in spring fabrication.

SEM/EDX analysis of the electrical contacts returned from the field giving high static resistance generally showed in micrographs a dark contaminant embedded in the wear track and not found in unworn contact areas. Semiquantitative EDX analysis showed no compositional differences between the dark contaminant and the surrounding light areas.

Since the EDX could not resolve the chemistry of the contaminant, it was deduced that the contaminant was organic (C, O, H, N), and/or a deposit submicron in thickness.

To confirm, if possible, such deduction, the worn contacts were then analyzed on the SAM 590. The Auger electron spectrum (derivatives of electron energy distribution as a function of Auger electron kinetic energy) identified a significant carbon peak, and minor oxygen and nitrogen peaks; at the same time it showed a low concentration of gold. Given that oxygen and nitrogen are common atmospheric contaminants, they were sputtered off, using argon to sputter off the surface so as to lower it by 50 Angstrom units. The area then showed reduction in carbon intensity and the exposure of a major nickel peak and minor copper peak. Cobalt's Auger electron peaks were probably hidden by those of nickel. The noise in these spectra are common to electrically charging organic materials.

To better explain the distribution of these elements over the area of view, an Auger electron map for carbon was made. This Auger map complemented the embedded material shown in the SEM micrograph, thus indicating the material to be an organic film thicker than 40 Angstrom units. A surface line scan done by the SAM 590 verified the concentration of carbon to be most intense in the wear track. The corresponding line scans for gold and nickel, which are slightly suppressed or "masked" in the organic rich zone tended to be supplementary in nature; a localized increase in relative nickel intensity was matched by a localized decrease in relative gold intensity. From these line scans, nickel-rich areas (agglomerates), although not visible on the SEM micrograph, were estimated from the peak widths to be on the order of 6 to 8 microns mean diameter.

Similar Auger electron spectrum analysis on an electrical contact from the field, which exhibited no contact resistance failure (#3), showed a lower carbon (organic) intensity, and no inhomogeneities in carbon intensity in the wear track after argon sputtering producing surface lowering of 50 Angstrom units.

These results indicated that the detrimental surface contaminant is organic in nature, is greater than 50 Angstrom units in thickness, and is embedded in the wear track of the electrical contact.

To better determine the character of such contaminant associated with the field failure mechanism, as-received tapes from suppliers with a base of 80% copper and 20% nickel (percentage by weight) and an overlay of 699 alloy were treated in 2 percent o-toluidine to 98 percent ethanol solution, 20 KHz, 40 watt ultrasonic bath; maximum exposure 300 seconds.

Alcohol vapors such as ethanol are common in medical environments. Ortho-toluidine ($C_7H_9N$) is a monomer used in air conditioning filters and antiseptics. For this reason, it was chosen as an additional source of possible airborne organic contamination. The liquid solution is assumed to be more aggressive than the vapor phase.

An unusual phenomenon observed when the alloy 699 contacts were so treated in an ultrasonically activated solvent bath was the formation of spotted contaminations patterning the cobalt/nickel agglomerates. Given the consistency of this phenomenon, it was thought that this technique might warrant itself as a laboratory technique to simulate formation of an organic surface contaminant.

Cavitation is the generation of microvoids (microcavities) caused by the mechanical breakdown of the gas filled liquid, when it is subjected to high internal stresses equaling or exceeding principally the ambient pressure. These microvoids are pressurized to levels in excess of $10^6$ dynes/cm$^2$, and the microvoid pressure increases with decreasing microvoid radius. These microvoids are produced under steady state conditions by the negative half pressure cycle of the ultrasound wave. The positive half pressure cycle implodes these microvoids generating high localized pressures. It has also been theorized that upon implosion, localized high temperature gradients are also formed. The mechanical thermal driving force contribution from the cavitation in the ultrasonic bath (Branson 40 watt 20 KHz) is that to accelerate the contamination nucleation and growth.

Samples of the alloy 699 contacts were immersed 300 seconds.

SEM/EDX analysis of the as-received alloy 699 tape having an identical alloy composition to the field-returned electrical contacts was undertaken. After the toluidine-ultrasound treatment, dark surface agglomerates on the order of 6 to 8 microns mean diameter were clearly revealed on the as-received 699 alloy tapes, as observed previously on the field-returned contacts. Again, SEM/EDX had no sensitivity to the composition of these areas, therefore, Scanning Auger Microscopy (SAM) was again pursued. Auger electron spectra revealed a very intense carbon peak, and residual oxygen. A substantial nickel peak was also revealed. Auger electron mapping for carbon in the area of view showed good correlation between intense carbon areas and the dark agglomerates in the SEM micrograph. These findings indicate that organic material had selectively deposited on these surface agglomerates of this alloy. The mean diameter of these contaminant islands, 6 to 8 microns, is in excellent agreement with the size of nickel cobalt alloy agglomerates estimated for the field-returned contacts by SAM 590 analysis, and previously defined by microscopic examination of microtomed alloy 699 specimens.

The cumulative field, SEM/EDX and AES data set out above suggest that agglomerated nickel, on the order of 6 to 8 micron mean diameter, is a preferential surface for adsorption of organic material. The comparison of organic surface area coverage on the field defective and ultrasound treated tape samples of alloy 699 demonstrates that the organic material is greater in thickness than 1700 Angstrom units and can grow in surface area to approximately 160 micron mean diameter. Apparently organic film thicknesses greater than 1700 Angstrom units are required to cause contact failure. The observations discussed above describe a polymerization process catalyzed by the transition element nickel (and cobalt). It is known that nickel forms complex ions with ligands or chelating agents such as organic ions or monomers. This phenomenon was demonstrated in the instance where the ethanoltoluidine ultrasound treatment of samples of as-received contat tape with 699 alloy generated a surface film similar to that absorbed on field-returned alloy 699 contacts.

However, as later pointed out, a critical size of nickel-cobalt-organic complex is considered to be necessary for catalysis of polymerization.

The energy required for polymerization is supplemented by the localized thermomechanical energy from frictional wear, in the field, or ultrasonic cavitation in the laboratory.

The phenomena of field failure in hospital environments of contacts using 699 alloy is, therefore, classified as types of polymer formation involving low cycle wiping wear and organics such as ethanol and o-toluidine. Although used in the liquid state in this study in connection with the analysis of as-received 699 alloy contacts, such organics are volatile so that the monomer can be carried to the reactive surfaces by air to polymerize and form polymer deposits on such surfaces. (The formation of such deposits is similar to friction polymerization.)

We have discovered that, in environments where the electric contact tapes of spring contacts are exposed to airborne vapor of ethanol or other organic substances, the formation of failure producing polymeric deposits on the overlays of such tapes can be eliminated or long delayed by using as the constituent material for such overlays an alloy which is constituted of a percentage by weight of nickel in the range of from about 1.8% to about 2.3%, the balance of the alloy conveniently being pure gold, although it also may be an admixture of gold and of trace percentages by weight of one or more metals which do not precipitate out of solution so as to become segregated from the gold. While such alloy will, for the higher values in such range of nickel, contain agglomerates of nickel, which contribute to the suitability of the overlay as an electrical contact surface, these agglomerates are too small in size for the contaminating airborne organic substances to become deposited in significant amounts on such surface by polymerization. The character of such discovery will be made more clear by the following examples and discussion.

EXAMPLE I

There was fabricated some electrical contact material 11 in the form of a roll of contact tape having the structure described above in connection with FIG. 1 and comprising a base 12 of pure nickel and an overlay 13 constituted, in percentages by weight, of about 2.3% nickel and about 97.7% essentially pure gold (2.3 w/o nickel, 97.7 w/o gold). The tape so fabricated was used to provide the nibs 27 of sample spring contact assemblies 25 of the kind shown in FIGS. 2 and 3 and having phosphor bronze leaf spring members 26. Such sample spring contact assemblies with their contact surfaces provided by the 2.3 w/o nickel, 97.7 w/o gold overlay were subjected to testing identical to that to which the 699 alloy was subjected as described above. The 2.3 w/o nickel, 97.3 w/o gold composition was formulated to use an amount of nickel that would (1) yield a fine precipitate at room temperature after it was aged; (2) mostly stay in solution at the processing temperatures of from 250° C. to 950° C. which conceivably could be used in manufacturing the electrical contact material, hence no detrimental agglomerates would occur by significant precipitation of nickel out of solution with the gold during such manufacturing; and (3) be only slightly more than the composition for solid solution at room temperature (1.8 w/o nickel in gold) at which no precipitation at room temperature of nickel will occur so as, thereby, to keep the grains from growing excessively large while imparting higher mechanical strength (because of fine grains) and, also, providing finely dispersed relatively hard nickel particles which would impart greater wear and prevent contact sticking (cold welding).

It was found that spring contact assemblies 25 built for field testing and containing wiping contacts fabricated from the 2.3 w/o nickel to 97.7 w/o gold alloy showed no static resistance instabilities after four months.

The electrical contact tape with the overlay of 2.3 w/o nickel, 97.7 w/o gold was also treated with the same ultrasonically activated solvent bath as that to which the tape with 699 alloy was subjected as previously described. SEM analysis of the so-treated 2.3 w/o nickel, 97.7 w/o gold alloy tape showed a very fine surface structure revealing plausible agglomerates less than 1.6 micron mean diameter after the ethanol-toluidine-ultrasound treatment. After sputtering 50 Angstrom units from the surface, the carbon peak was insignificant and no organic contaminant inhomogeneities having significant contaminating effects were observed. Of course, some nickel was identified but, the peak was only 40 percent as intense as the corresponding peak for alloy 699 tape.

The tests just described indicate that the field tested spring contact assemblies with a contact surface provided by 2.3 w/o nickel, 97.7 w/o gold alloy are characterized by small nickel agglomerates of about 1.6 micron mean diameter and by some areas of polymeric deposits of airborne organic substances, but that such areas were sufficiently scarce and small as to not significantly degrade the electrical performance of the contacts. In fact, from the viewpoint of stability of static resistance, such contact assemblies were, after four months field testing, comparable in performance with spring contact assemblies having contact surfaces of pure gold.

EXAMPLE II

There were fabricated spring contact assemblies 25 identical with those described in Example I except for having a composition, in percentage by weight, of 2.0% nickel, 98.0% gold for the overlay 13 of the contact nibs 27 of such assemblies. Those assemblies were subjected to tests identical to those described above in Example I. Such tests indicated that the contact surfaces of the field tested spring contact assemblies of this Example II were devoid of any nickel agglomerates and of any polymeric deposits of airborne organic substances. Such contact surfaces continued to have, to a wholly adequate extent, the qualities desirable for good electrical performance of mechanical strength, resistance to wear and freedom from sticking.

EXAMPLE III

For control purposes, spring contact assemblies having contact surfaces provided by pure gold were subjected to the same field testing as that to which the spring assemblies of Examples I and II were subjected. The spring contact assemblies with such overlays of pure gold exhibited, of course, high stability of static resistance, but were somewhat deficient in the qualities for the overlay of mechanical strength, hardness (and thus resistance to wear) and anti-sticking.

DISCUSSION

From the tests described above and from other practical and theoretical considerations, the following can be said about electric contact material 11 having an overlay 13 of gold-nickel alloy, and about spring contact assemblies 25 having nibs 27 made from such contact material.

The alloy of the overlay should include some nickel which will precipitate out of solution with the gold in order to impart to the contact surface a certain degree of graininess, and to give the overlay the qualities (desirable for good electrical performance of the contact surface of the spring contact assemblies) of adequate mechanical strength, hardness (which yields resistance to wear) and freedom from sticking to the contact surface of another contact element upon making closure therewith. The lower limit for the nickel content of a gold-nickel alloy at which some of the nickel will precipitate out of solution with the gold is about 1.8% percentage weight by nickel. Therefore, that percentage weight is the lowest practical value according to the invention for the nickel content of gold-nickel alloys used to provide the overlay of the electric contact material 11 and the contact surface of the spring contact assemblies 25.

On the other hand, the practical upper limit for such nickel content is about 2.3% by weight inasmuch as a percentage (by weight) of nickel significantly exceeding that value (as, for example 3% by weight of nickel) will result in hospital and similar environments in the polymeric deposition on the contact surfaces of spring contact assemblies of originally airborne organic contaminants to the extent that the electric performance of such assemblies will become degraded, and an undue number of such assemblies will fail.

Hence, the nickel content of the alloy used to provide the contact surface of the described contact material 11 and spring assemblies 25 should, according to the invention, be in the range, in percentage by weight, from about 1.8% to about 2.3%, but it may have any value within that range.

The balance of the percentage by weight of such alloy may conveniently be essentially pure gold. If desired, however, such balance may be constituted almost wholly of gold but including trace percentage weights of one or more other metals (other than nickel) of which the amount present in the gold of each of such one or more metals is insufficient for that metal to precipitate out of the gold and thus become segregated therefrom.

As stated, the base of the contact material 11 may conveniently be nickel, nickel alloy, copper or copper alloy, but such base may, within the invention, be constituted of any metallic substance which permits electromechanical joinder of a body of the contact material 11 to an underlying metallic spring member and which, moreover, inhibits diffusion of the metallic material of such member through the base to the overlay part of the contact material.

Similarly, the metallic substance of which such spring member is constituted may conveniently be phosphor bronze or like material but may, within the invention, be any metallic material which permits electromechanical joinder thereto of the base of a body of the contact material, and which otherwise has mechanical and electrical properties rendering such member suitable for use in spring contact assmblies.

Although the spring contact assemblies disclosed herein have been described as providing a wiping contact, spring contacts embodying the invention may also be of types which provide other kinds of contacts as, say, compression contacts or vibratory contacts.

While the foregoing sets forth a plausible explanation of why electric contact surfaces of goldnickel alloys of the described improved sort significantly reduce the rate of contact failures in environments in which airborne organic substances may contaminate such surfaces, we do not intend to be bound by such explanation, and the invention hereof is not to be considered as limited in dependence on the accuracy of such explanation.

The above-described embodiments being exemplary only, it is to be understood that additions thereto, omissions therefrom and modifications thereof may be made without departing from the spirit of the invention. Thus, it will be evident that the invention is not limited to spring contacts or electrical contact materials but, rather, encompasses any electrical contact structure comprising base means providing a metallic electroconductive base surface and an electric current conduction path including such surface, and, also, an overlay on such surface of gold-nickel of the improved sort described herein. Accordingly, the invention is not to be considered as limited save as is consonant with the scope of the following claims.

What is claimed is:

1. An electrical contact structure comprising, base means providing a metallic electroconductive base surface and a current path for flow of electric current between such surface and another location, and an overlay on such base surface and having an inner surface bonded to such base surface and an outer surface providing an electrical contact surface, said overlay being constituted of a gold-nickel alloy in which the amount of nickel in said alloy is restricted to a range extending from about 1.8% to about 2.3% of the percentage by weight of said alloy, the balance of the percentage by weight of said alloy being constituted of gold with or without one or more other metals other than nickel in trace amounts insufficient to produce precipitation of such one or more metals out of solution in said gold, said nickel being present in said overlay in the form of a dispersion of fine grain nickel particles which are precipitated from solution out of the surrounding gold, and which impart graininess to said electrical contact surface, and any nickel agglomerates exposed at said surface being essentially limited in size to a mean diameter of at most about 1.6 microns.

2. An electrical contact means comprising:

(a) a spring contact assembly comprising;

(i) a nib constituted of a base portion of metallic material and a metallic overlay portion bonded to one side of said base portion and adapted to provide an electrical contact surface, said overlay portion being constituted of a gold-nickel alloy in which the amount of nickel in said alloy is restricted to a range extending from about 1.8% to about 2.3% of the percentage by weight of said alloy, the balance of the percentage by weight of said alloy being constituted of gold with or without one or more other metals other than nickel in trace amounts insufficient to produce precipitation of such one or more metals out of solution in said gold, said nickel being present in said overlay portion in the form of a dispersion of fine grain nickel particles which are precipitated from solution out of the surrounding gold, and which impart graininess to said electrical contact surface, and any nickel agglomerates exposed at said surface being essentially limited in size to a mean diameter of at most about 1.6 microns, and (ii) a leaf spring member having said base portion bonded to one side thereof so that the overlay portion of said nib is on the side of said nib away from said spring member; and (b) a contact element in addition to said spring contact assembly and cooperable with said electrical contact surface thereof to undergo a succession of closures with said surface and to make wiping contact with it in the course of each of said succession of closures.

* * * * *